United States Patent [19]

Sato et al.

[11] Patent Number: 4,556,631

[45] Date of Patent: Dec. 3, 1985

[54] SELF-PROCESSING TYPE FILM UNIT AND METHOD OF MANUFACTURING THE SAME

[75] Inventors: Susumu Sato; Yoshio Hara, both of Kanagawa, Japan

[73] Assignee: Fuji Photo Film Co., Ltd., Kanagawa, Japan

[21] Appl. No.: 409,807

[22] Filed: Aug. 20, 1982

[30] Foreign Application Priority Data

Aug. 25, 1981 [JP] Japan ..... 56-132929

[51] Int. Cl.[4] ..... G03C 5/54; G03C 1/96

[52] U.S. Cl. ..... 430/498; 430/209; 354/304

[58] Field of Search ..... 430/209, 498; 354/304

[56] References Cited

U.S. PATENT DOCUMENTS 4,042,395 8/1977 Tone et al. ..... 430/209

4,247,626 1/1981 Poshkus et al. ..... 430/209

*Primary Examiner*—Richard L. Schilling

*Attorney, Agent, or Firm*—Sughrue, Mion, Zinn, Macpeak & Seas

[57] ABSTRACT

In a self-processing type film unit comprising a base sheet bearing thereon a photosensitive layer, a masking member which is attached to the base sheet and has an opening for exposing the photosensitive layer on the base sheet, a transparent cover sheet attached to the masking member at its side edges to cover the opening of the masking member with a spacer member interposed between each of the side edges and the masking member, a developing solution container enclosed by the leading end portion of the masking member which is folded back around the developing solution container over the cover sheet and attached to the cover sheet, and a developing solution trapping member enclosed by the trailing end portion of the masking member which is folded back around the developing solution trapping member over the cover sheet and attached to the cover sheet, a space formed between trailing end faces of the cover sheet and the spacer member, and the inner surface of the folded trailing end portion of the masking member at each side is closed.

2 Claims, 11 Drawing Figures

SELF-PROCESSING TYPE FILM UNIT AND METHOD OF MANUFACTURING THE SAME

BACKGROUND OF THE INVENTION

1. Field of the Invention

This invention relates to a self-processing type film unit for an instant camera in which developing solution contained in the film unit is distributed over an image forming area thereof after exposure to light to develop it on the spot.

2. Description of the Prior Art

As is well known, a self-processing type film unit for an instant camera generally includes a developing solution container disposed near the leading end thereof and means for trapping excess developing solution disposed near the trailing end thereof. The instant camera is arranged to feed the film unit after exposure to light in between a pair of spreading rollers which are rotated while nipping the film unit to discharge it outside the camera body. When the leading end portion of the film unit is passed between the spreading rollers, the developing solution container disposed therein is broken by the nipping force of the rollers and the solution is released. The released solution is spread over the image forming area which has been exposed, being pushed by the spreading rollers. In the conventional self-processing type film unit, there has been a problem that a part of excess developing solution which is a strong alkali and black in color leaks out of the film unit to contaminate the skin and/or clothes of the user, or the spreading rollers. When the spreading rollers are contaminated by the developing solution, the next several film units are also contaminated and the clearance between the rollers is changed to affect the spreading characteristics of the solution.

FIGS. 1 to 4 show a typical conventional self-processing type film unit. The film unit comprises a base sheet 2 bearing thereon a photosensitive layer 1, a masking member 4 which has an opening 3 defining an image forming area and is superposed on the base sheet 2, and a transparent cover sheet 5 superposed on the masking member 4 to cover the opening 3. The masking member 4 is longer than the base sheet 2 to extend beyond the ends of the base sheet 2. On the end portion 6 of the masking member 4 extending beyond the leading end (the film unit is fed in between the spreading rollers of the instant camera in the direction of the arrow A) of the base sheet 2 is disposed a developing solution container 7 and the end portion 6 is folded back over the cover sheet 5 along a folding line 10 with the solution container 7 being held between the upper run and the lower run of the masking member 4 as shown in FIG. 2. Then, the outer edge and the side edges of the end portion 6 are secured to the upper surface of the cover sheet 5. The cover sheet 5 has extensions 12*a* and 12*b* on the side edges 13*a* and 13*b* extending beyond the leading end 14 thereof, and the side edges of the end portion 6 of the masking member 5 are respectively secured to the extensions 12*a* and 12*b* near the folding line 10. When the cover sheet 5 is not provided with such extensions, the side edges of the end portion 6 may be secured to the side edges of the lower run of the masking member 4 near the folding line 10. The other end portion 8 is folded around a developing solution trapping member 9 along a folding line 11 onto the upper surface of the cover sheet 5 and is secured thereto at the outer edge and the side edges. The cover sheet 5 is secured to the masking member 4 only at the side edges 13*a* and 13*b* with the leading end 14 and the trailing end 15 being not secured to the masking member 4. Accordingly, the space in the bag-like portion formed by the end portion 6 of the masking member 4 at the leading end of the film unit communicates with the space in the bag-like portion formed by the end portion 8 at the trailing end of the film unit by way of the space between the cover sheet 5 and the base sheet 2, or more strictly by way of the spaces between end portions of the cover sheet 5 and the masking member 4 and between the intermediate portion of the cover sheet 5 and the intermediate portion of the base sheet 2. The thickness of the space between the cover sheet 5 and the base sheet 2 constitutes one of the factors which determine the spread state of the developing solution which is spread over the image forming area when the container 7 is broken by the spreading rollers. Therefore, the side edges 13*a* and 13*b* of the cover sheet 5 are attached to the masking member 4 sandwiching therebetween elongated spacers 16*a* and 16*b* in order to obtain optimum thickness of the space between the cover sheet 5 and the base sheet 2.

FIGS. 2 shows a film unit 17 in the assembled state. After the photosensitive layer 1 is exposed to light through the transparent cover sheet 5 and the opening 3 of the masking member 4, the film unit 17 is fed in between a pair of spreading rollers 18*a* and 18*b* of the instant camera rotating in the directions of the arrows B from its leading end portion containing therein the developing solution container 7. When the leading end portion of the film unit 17 is passed through the spreading rollers 18*a* and 18*b*, the developing solution container 7 is broken by the nipping force of the rollers 18*a* and 18*b* and the developing solution 7' contained therein is released. The released developing solution 7' is spread or distributed in the space between the cover sheet 5 and the base sheet 2 over the image forming area. Excess solution spread beyond the image forming area is trapped by the solution trapping member 9 disposed in the trailing end portion of the film unit 17.

Observations of the inventors have revealed that the excess developing solution leaks out of the film unit 17 through air escape holes 19 (FIG. 3) provided in the masking member 4 or through spaces 21 formed between the inner surface of the masking member 4 and the trailing end faces 5*c* and 16*c* of the cover sheet 5 and the spacer 16*a* (16*b*) at both sides. Since the cover sheet 5 and the spacers 16*a* and 16*b* have thickness, and the masking member 4 (generally formed of a plastic film) has rigidity, the space 21 is inherently formed between the trailing end faces 5*c* and 16*c* of the cover sheet 5 and the spacer 16*a* (16*b*) and the inner surface of the folded portion of the masking member 4 at each side of the unit (See FIG. 4). Generally, the width of the space 21 can be held smaller than 0.2 to 0.3 mm. By selecting the volume of the solution container 7 and the distribution of the solution in the container 7 taking into account the space 21, the leak of the solution through the space 21 can be prevented. In fact, the volume of the container 7 and the distribution of the solution therein have been strictly adjusted intending to prevent the leak of the solution. However, in order to prevent the leak of the solution, the volume of the container 7 and the solution distribution therein must be controlled with a high accuracy on the order of 0.01 cc. This, in addition to the fact that the width of the space 21 must be kept smaller than 0.2 to 0.3 mm, makes manufacture of the film units very difficult. Further, even if the width of the space 21 and the container 7 can be formed with the required high accuracy, still there is the possibility of the leak of the solution especially when the camera is used under high temperature and high humidity.

When the developing solution is spread over the image forming area in the pattern shown in FIG. 5A in which the solution is spread near the center of the unit 17 faster than near the edges of the unit, there is less possibility of the leak of the solution through the space 21. Recently, an attempt has been made to spread the solution in a relatively square pattern rather than the tongue-like pattern shown in FIG. 5A in order to evenly distribute the solution over the image forming area and to reduce the amount of excess solution. A pair of examples of the square solution spread pattern are shown in FIGS. 5B and 5C. When the solution is spread over the image forming area in a relatively square pattern, there is more possibility of the leak of the solution through the space 21. This is because a larger amount of solution is spread near the edges of the unit 17 and excess solution reaches the spaces 21 at the trailing end of the unit 17. Therefore, the solution spread pattern of FIG. 5C cannot be used so long as the space 21 exists even though the pattern may be preferred in order to obtain better reproduced image quality.

SUMMARY OF THE INVENTION

In view of the foregoing observations and description, the primary object of the present invention is to provide an improved self-processing type film unit and a method of manufacturing the same in which the leak of the developing solution through the corners of the trailing end thereof is effectively prevented irrespective of the spread pattern of the solution without significantly complicating the manufacturing steps.

In accordance with the present invention, the spaces conventionally formed at the corners of the trailing end of the unit are closed.

The spaces may be closed by fusing together the members forming it using an ultrasonic sealer, inpulse sealer or the like after the components are assembled together. In a preferred embodiment of the present invention, sealing material is drip-fed to the surface of the masking member near the trailing end of each side edge of the cover sheet before the trailing end portion of the masking member is attached to the upper surface of the cover sheet folded around the solution trapping member, so that the sealing material seals the space formed between the trailing end faces of the masking member and the spacer, and the inner surface of the folded trailing end portion of the masking member at each side when the trailing end portion is subsequently attached to the cover sheet.

DESCRIPTION OF THE PREFERRED EMBODIMENT

Figure 1:
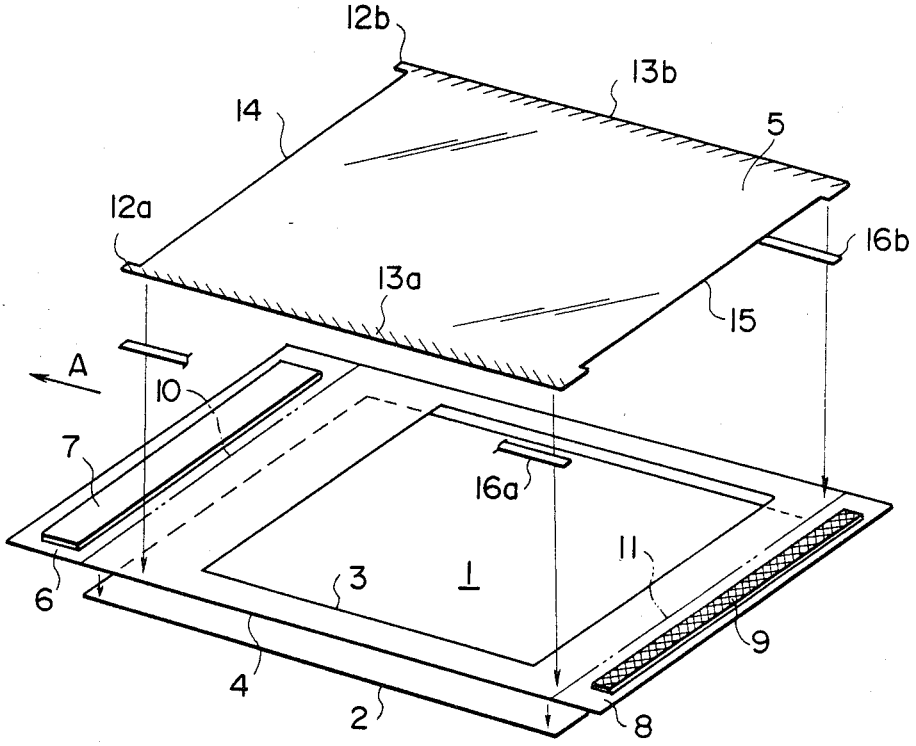
FIG. 1 is an exploded perspective view of a film unit in accordance with the prior art.
Figure 2:
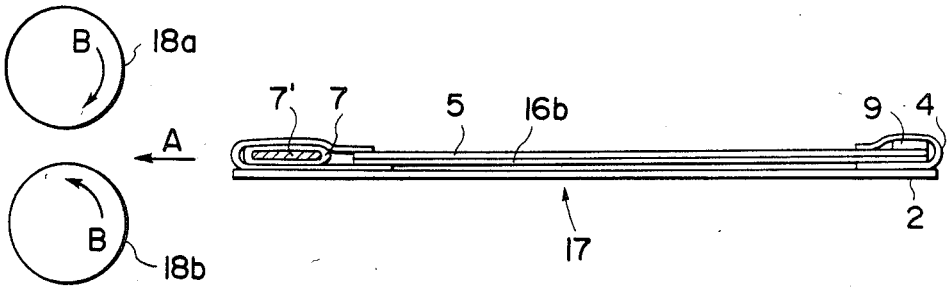
FIG. 2 is a sectional view of the film unit shown in FIG. 1 but in assembled state.
Figure 3:
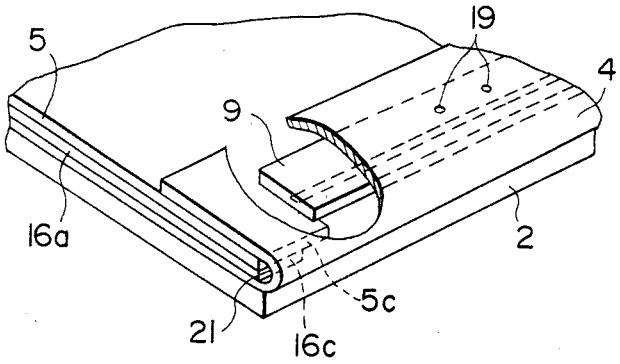
FIG. 3 is an enlarged fragmentary perspective view, partly broken away, of the film unit shown in FIG. 1 but in assembled state.
Figure 4:
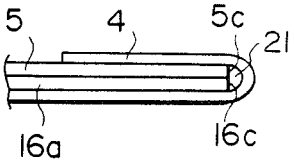
FIG. 4 is a fragmentary side view of the film unit shown in FIG. 1 but in assembled state, FIGS. 5A to 5C respectively show various spread patterns of the developing solution.
Figure 5A:
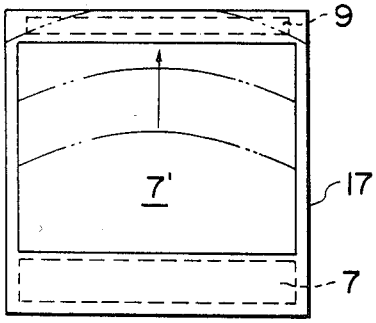
Figure 5B:
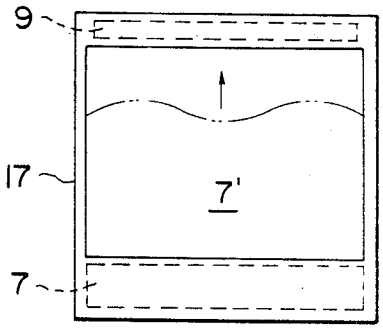
Figure 5C:
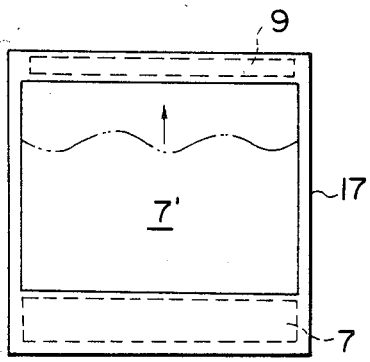
Figure 6:
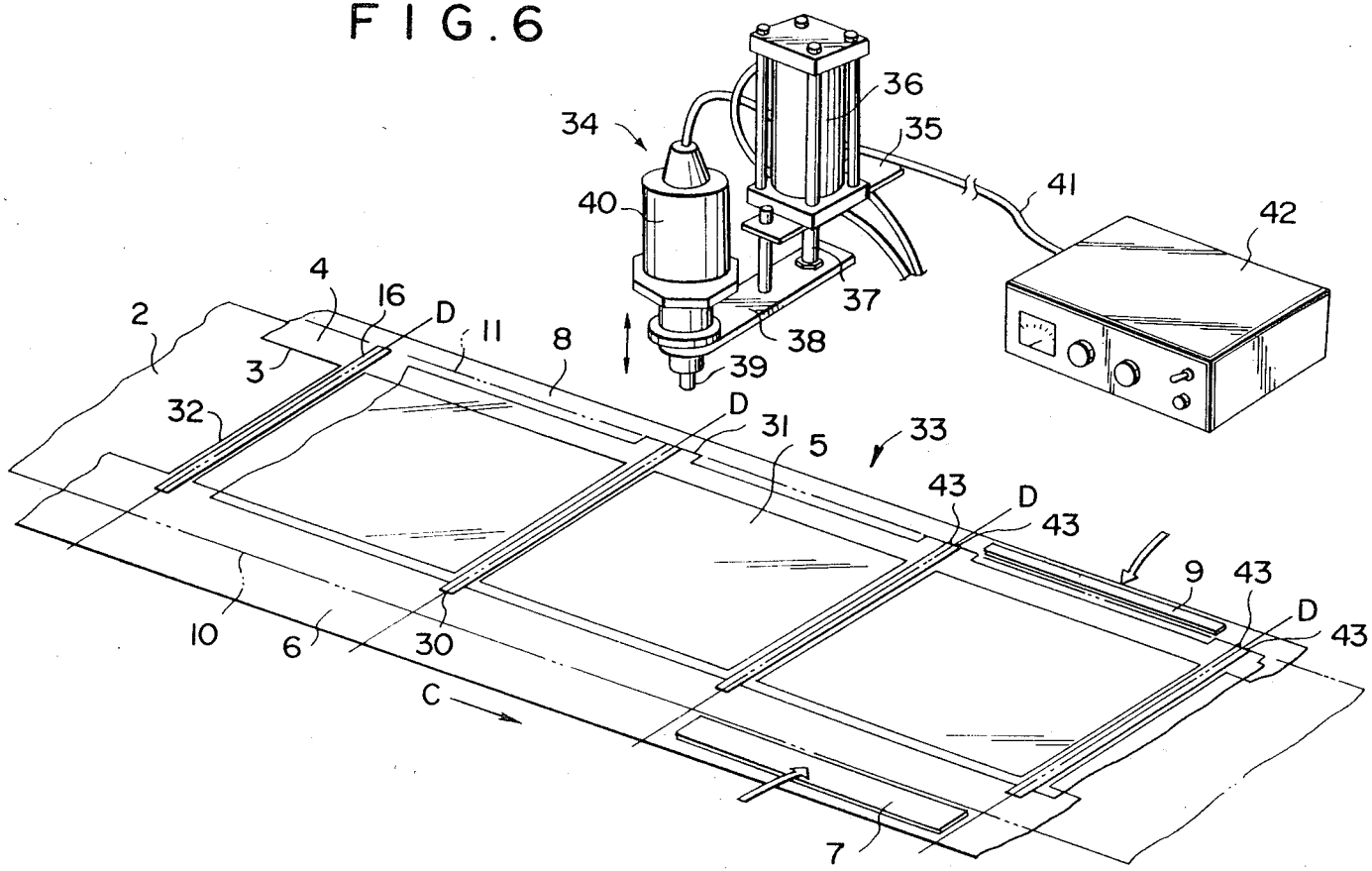
FIG. 6 is a perspective view showing a system for carrying out a method of making a film unit in accordance with an embodiment of the present invention.
Figure 7:
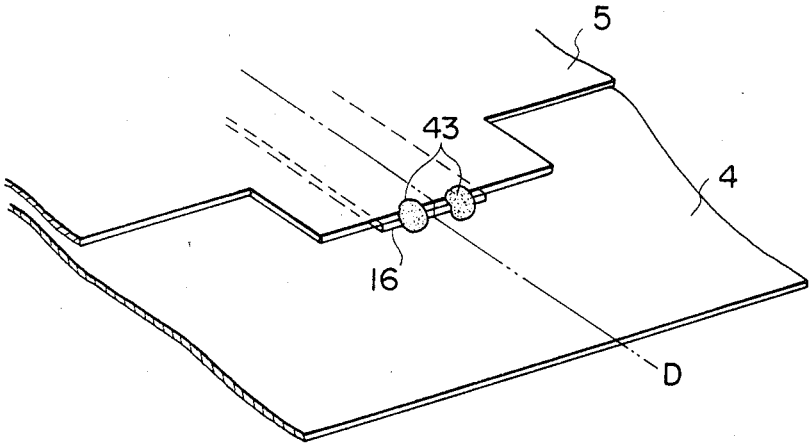
FIG. 7 is a perspective view showing the film unit made by the system of FIG. 6 before completed.
Figure 8:
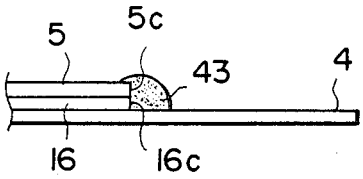
FIG. 8 is a fragmentary side view of FIG. 7.
Figure 9:
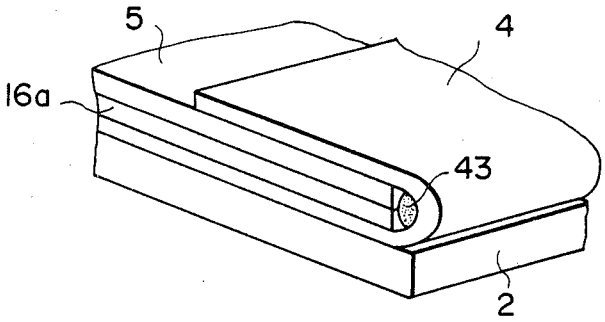
FIG. 9 is an enlarged fragmentary perspective of a film unit made using the system of FIG. 6.

FIG. 6 shows a system for carrying out the method of the present invention. In FIG. 6, a device for closing the relevant space is provided in a film unit manufacturing line in which continuous base sheet 2, masking member 4 and cover sheet 5 are fed in a superposed state and subsequently severed in the direction transverse to the longitudinal direction thereof to continuously manufacture a plurality of film units. On the continuous base sheet 2 bearing thereon a photosensitive layer is superposed a continuous masking member 4 having a plurality of openings 3 for defining the image forming area of the finished film arranged in a row in the longitudinal direction of the continuous masking member 4. On the continuous masking member 4 is superposed a continuous cover sheet 5 having extensions 30 and 31. The base sheet 2, the masking member 4 and the cover sheet 5 are secured to each other. The cover sheet 5 is attached to the masking member 4 by providing a spacer 16 on each connecting section between adjacent individual masking members and attaching the upper and lower surface thereof to the cover sheet 5 and the masking member 4, respectively. The laminated sheet 33 thus formed is fed intermittently in the direction of the arrow C at a pitch equal to the center-to-center distance between the adjacent openings of the masking member 4. In the laminated sheet 33 shown in FIG. 6, the masking member 4 has been provided with folding lines 10 and 11 by cutting it halfway in the direction of the thickness. While the laminated sheet 33 is stopped, the solution container 7 and the solution trapping member 9 are secured to the masking member 4 at the leading end portion 6 and the trailing end portion 8 on opposite sides of the opening 3 in the direction transverse to the laminated sheet feeding direction. The laminated sheet 33 is fed to a folding station (not shown) after the solution container 7 and the solution trapping member 9 are secured to the masking member 4 and the leading end portion 6 and the trailing end portion 8 are folded back over the cover sheet 5. Then the leading end portion 6 and the trailing end portion 8 are fused to the upper surface of the cover sheet 5 at a fusing station using for example an ultrasonic sealer (not shown).

We claim:

1. A self-processing type film unit comprising a base sheet bearing thereon a photosensitive layer, a masking member which is attached to the base sheet and has an opening for exposing the photosensitive layer on the base sheet, a transparent cover sheet attached to the masking member at its side edges to cover the opening of the masking member with a spacer member interposed between each of the side edges and the masking member, a developing solution container enclosed by the leading end portion of the masking member which is folded back around the developing solution container over the cover sheet and attached to the cover sheet, and a developing solution trapping member enclosed by the trailing end portion of the masking member which is folded back around the developing solution trapping member over the cover sheet and attached to the cover sheet, characterized in that a space formed between trailing end faces of the cover sheet and the spacer member, and the inner surface of the folded trailing end portion of the masking member at each side is closed.

2. A method of manufacturing a self-processing type film unit comprising a step of attaching a masking member having an opening to a base sheet bearing thereon a photosensitive layer so that the photosensitive layer is exposed through the opening to define an image forming area, a step of providing a transparent cover sheet on the masking member over the opening and attaching each side edge of the cover sheet to the masking member with an elongated spacer interposed therebetween, a step of providing a developing solution container on the leading end portion of the masking member, a step of folding back the leading end portion around the developing solution container over the cover sheet, a step of attaching the leading end portion to the outer surface of the cover sheet to enclose the developing solution container, a step of providing a developing solution trapping member on the trailing end portion of the masking member, a step of folding back the trailing end portion around the developing solution trapping member over the cover sheet, and a step of attaching the trailing end portion to the outer surface of the cover sheet to enclose the developing solution trapping member, characterized by further comprising a step of drip-feeding sealant onto the surface of the masking element near the trailing end faces of the cover sheet and the spacer member prior to the step of attaching the trailing end portion to the outer surface of the cover sheet, so that the sealant seals a space formed between the trailing end faces and the inner surface of the folded portion of the trailing end portion of the masking member at each side when the trailing end portion is subsequently attached to the cover sheet.

* * * * *